US010182625B1

(12) United States Patent
Humbert, Jr. et al.

(10) Patent No.: US 10,182,625 B1
(45) **Date of Patent: *Jan. 22, 2019**

(54) RING RE-SIZING ATTACHMENT

(71) Applicant: John Humbert, Jr., Barnegat, NJ (US)

(72) Inventors: John Humbert, Jr., Barnegat, NJ (US); Bennet Otto Poepping, Tuckahoe, NY (US)

(73) Assignee: John Humbert, Jr., Barnegat, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/720,309

(22) Filed: Sep. 29, 2017

Related U.S. Application Data

(63) Continuation of application No. 15/347,236, filed on Nov. 9, 2016, now Pat. No. 9,775,415.

(51) Int. Cl.
*A44C 9/02* (2006.01)

(52) U.S. Cl.
CPC ..... *A44C 9/02* (2013.01)

(58) Field of Classification Search
CPC ..... A44C 9/02
See application file for complete search history.

(56) References Cited

U.S. PATENT DOCUMENTS

| | | | |
|---|---|---|---|
| 2,532,354 | A | 12/1950 | Hirsh |
| 2,615,314 | A | 10/1952 | Axel |
| 2,787,142 | A | 4/1957 | Axel |
| 3,362,189 | A | 1/1968 | DeSanto |
| 3,380,263 | A | 4/1968 | Nathan |
| 3,460,356 | A | 8/1969 | Lodrini |
| 3,933,010 | A | 1/1976 | Ulbrich |
| 4,480,447 | A | 11/1984 | Lodrini |
| 5,239,842 | A | 8/1993 | Gesensway |
| 6,003,334 | A | 12/1999 | Miller |
| 6,192,708 | B1 | 2/2001 | Mitchell |
| 6,748,764 | B1 | 6/2004 | Roemer |
| 7,150,164 | B2 | 12/2006 | Sills |
| 7,409,837 | B2 | 8/2008 | Smith |
| 7,526,864 | B1 | 5/2009 | Eisner |
| 2006/0162380 | A1 | 7/2006 | Czajka |
| 2007/0137249 | A1 | 6/2007 | Czajka |
| 2010/0083701 | A1 | 4/2010 | Huynh |
| 2012/0180523 | A1 | 7/2012 | Meyerhoff |
| 2013/0247612 | A1 | 9/2013 | Yan |
| 2014/0326022 | A1 | 11/2014 | Tosyali |

FOREIGN PATENT DOCUMENTS

| | | | |
|---|---|---|---|
| CN | 202445263 | U | 9/2012 |
| DE | 20218002 | U1 | 1/2003 |

*Primary Examiner* — Abigail E Troy
(74) *Attorney, Agent, or Firm* — Rogowski Law LLC

(57) ABSTRACT

A ring re-sizing attachment is appended to the internal circumference of a ring band so that a ring band large enough to pass over a knuckle remains comfortably fit around the digital finger below the knuckle. The attachment includes two or more telescoping buttons joined to a base, with a spring, such as a conical spring, urging the buttons away from the base. The spring is compressed and the buttons urged together to increase the space within the band to move the band beyond a knuckle. Once the band is beyond the knuckle, the spring urges the buttons away from the base to tighten the fit of the ring band around the finger.

11 Claims, 4 Drawing Sheets

RING RE-SIZING ATTACHMENT

CROSS-REFERENCE TO RELATED APPLICATION

This application is a continuation of U.S. patent application Ser. No. 15/347,236, filed Nov. 9, 2016, pending, the contents of which are incorporated by reference herein.

BACKGROUND

The present invention relates to jewelry, and particularly ring re-sizing attachments that may be appended to the bands of rings to enable persons with smaller finger diameters to wear rings of larger ring size without removing material from the ring band.

Jewelry wearers may develop large knuckles due to aging, arthritis or weight gain. Or, jewelry wearers may change ring size due to weight loss. Or, rings that were fit to another family member may be too large for the current wearer. All of these situations may cause a ring owner to consult with a jeweler to change the size of a ring.

When a ring is made or adjusted to fit over an enlarged knuckle, it may then be too large for the digital portion of the ring finger and will tend to turn on the finger. This makes the ring uncomfortable, and can harm the setting.

When a ring is re-sized by removing metal material to reduce, or adding metal material to enlarge, the ring band circumference, there are limits to the amount that ring bands may be stretched or cut down without weakening the ring structure and integrity or introducing imperfections. It also is expensive to pay a jeweler to enlarge or reduce the size of a ring band.

Mechanisms to re-size a ring band are shown in the prior art. Some ring re-sizing mechanisms seat a spring wire into a groove formed in the ring band, or append a spring wire to the inside of the band. U.S. Pat. No. 3,933,010 (Ulbrich) creates an internal groove in the ring band and inserts a profile wire ring inside. U.S. Pat. No. 3,460,356 (Lodrini) similarly modifies the ring band to have a groove to receive an auxiliary band. See also U.S. Published patent application US2010/0083701 A1 (Huynh) showing a spring of an arc of 210-270 degrees secured to the inside circumferential surface of the bottom of a ring band.

Some ring re-sizing mechanisms comprise a specialized ring band that includes a combination of springs. See U.S. Pat. No. 6,748,764 (Roemer)

Some ring re-sizing mechanisms drill holes into the ring band to seat leaf springs or other spring elements. U.S. Pat. No. 4,480,447 (Lodrini) shows a leaf spring received in slots in the ring band, where the leaf spring urges a saddle-shaped insert away from the inner circumference of the ring band. German Utility Model DE20218002 (U10 shows a pressure pad with a spring 30 that is positioned on a ring band. U.S. Pat. No. 7,150,164 (Sills) appends an air bladder to the inner ring band, and adjusts the ring size by expanding or contracting the size of the air bladder by introducing air through a valve.

While various types of ring re-sizing mechanisms are known in the prior art, the primary mechanism used commercially today by jewelers is to weld beads of metal into the ring band of a size that is large enough to pass a wearer's knuckle. The metal beads create pressure points against a wearer's finger to hold the ring in place on the finger beyond the knuckle. However, those pressure points are not comfortable, and the welding of metal weakens or mars the metal of the ring band.

There is still a need for improving the way ring sizes are modified without harming the appearance or integrity of the ring band, and providing greater user comfort. Lower cost options are also sought. The present invention fulfills these needs and provides further related advantages, as described herein.

BRIEF SUMMARY

According to one preferred embodiment, a ring re-sizing attachment has a base having a top surface and an opposite bottom surface. The bottom surface is adapted for appending to an inner circumferential surface of a ring band. Attached to the base are two or more buttons, with the buttons of a size and shape that nest together in telescoping relation.

A spring, preferably a conical spring, is held within a volume defined by the telescoping buttons. A bottom coil of the spring is in contact with the top surface of the base and held at least in part in the inner volume. The top coil of the spring is in contact with the first button at the top of the ring re-sizing attachment. The spring is adapted to urge the at least the first button and second button away from the top surface of the base.

Preferably, the ring re-sizing attachment has at least two, and more preferably, three or more buttons, with the third button defining an opening to receive the second button and the first button in telescoping relation, and so forth. The bottommost button is then adhered or joined to the top surface of the base. The bottommost button may have a sidewall that terminates in a foot or footer, and that foot or footer may be joined to or integral with the top surface of the base.

The bottom size of the base may be joined to the inner circumferential surface of the ring band with an adhesive. Preferably, two or more ring re-sizing attachments are joined to the ring band at predetermined locations, which may be spaced away from the ring setting.

Preferably, the base and the top surfaces of the buttons are arcuate, and of a shape to complement or match the curve of the inner circumferential surface of the ring band. In another aspect, the invention comprises a jewelry ring with a band having an inner circumference to which a first ring re-sizing attachment, and preferably a second ring re-sizing attachment, are joined or appended. Where the ring band is circular, the first ring re-sizing attachment may be appended or joined to the inner circumference at a location approximately 95 degrees to 175 degrees from a predetermined reference point and the second ring re-sizing attachment is spaced apart from the first ring re-sizing attachment, and appended or joined to the inner circumference at a location approximately 185 to 265 degrees around the circle from the predetermined reference point.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
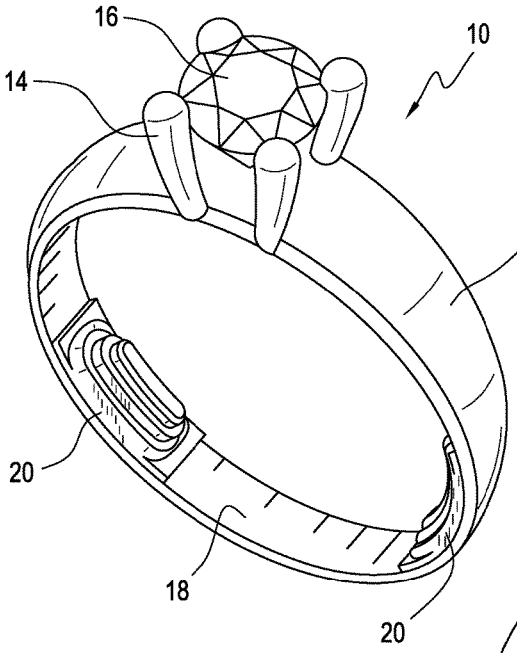
FIG. 1 is a right front perspective view of a ring that has two ring re-sizing attachments according to one embodiment of the invention appended thereto.

Reference will now be made in detail to the present embodiment of the invention illustrated in the accompanying drawings. The same or like reference numbers may be used in the drawings to refer to the same or like features. It should be noted that the drawings are in simplified form and not drawn to a precise scale.

In reference to the disclosure herein, for purposes of convenience and clarity only, directional terms such as top, bottom, above, below, front, rear, right, left, inner, and outer, are used with respect to the accompanying drawings. Such directional terms used in conjunction with the following description of the drawings should not be construed to limit the scope of the invention in any manner not explicitly set forth herein. Unless specifically set forth herein, the terms "a", "an" and "the" are not limited to one element but instead should be read as meaning "at least one". The terminology includes the words noted above, derivatives thereof and words of similar import.

Figure 2:
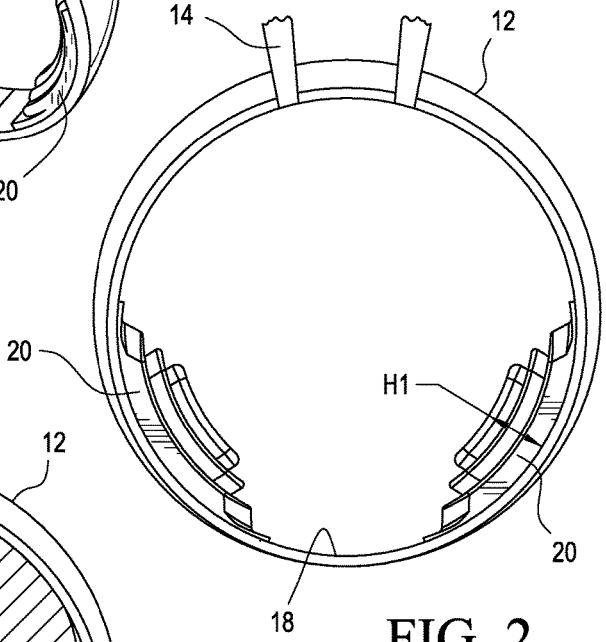
FIG. 2 is a front elevation view of the ring with ring re-sizing attachments of FIG. 1, with the diamond setting not shown.
Figure 3:
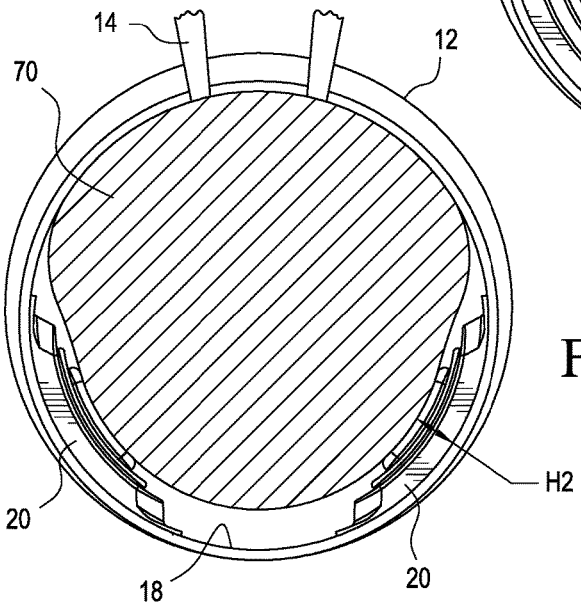
FIG. 3 is a front elevation view of the ring with ring re-sizing attachments of FIG. 1, with the diamond setting not shown, and with a representation of a user's finger in the ring depressing the ring re-sizing attachments.
Figure 4:
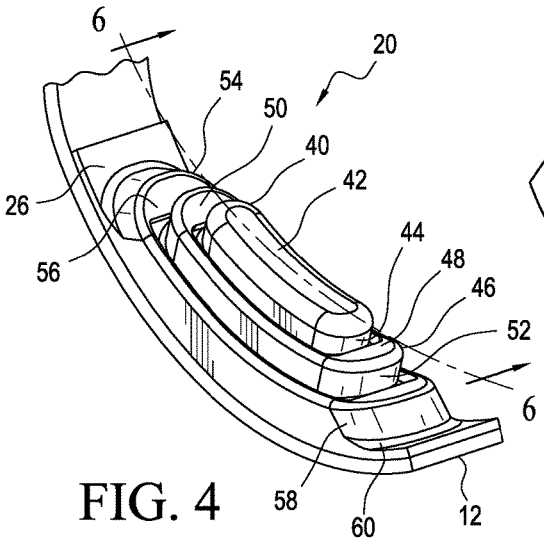
FIG. 4 is a right front perspective view of one ring re-sizing attachment according one embodiment of the invention.
Figure 5:
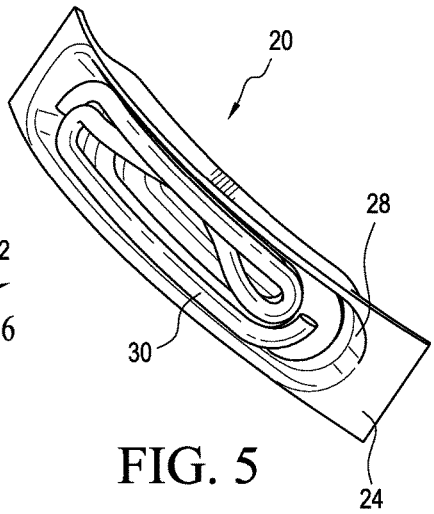
FIG. 5 is a bottom left perspective view of the ring re-sizing attachment of FIG. 4.

Turning in detail to the drawings, FIG. 1 shows a perspective view of a jewelry ring 10 having a band 12 and a setting 14 with a stone 16, such as a diamond as shown. Two ring re-sizing attachments 20 according to a first embodiment of the invention are appended to the inner surface 18 of the ring 12. When the ring 10 is not worn, as shown in FIG. 2, the ring re-sizing attachments 20 have a first height H1. When the ring 10 is worn over a finger 70 or is passed over a wider portion of a finger, such as a knuckle, the ring re-sizing attachment 20 is compressed and has a second height H2 as shown in FIG. 3.

FIGS. 4-7 show the ring re-sizing attachment 20 in more detail. The ring re-sizing attachment 20 has a base 22 with a bottom surface 24 that is appended or adhered or joined to the inner surface 18 of a ring band 12. The base 22 also has a top surface 24. The base 20 defines an opening or inner volume 28 into which a conical spring 30 is held.

A set of buttons is joined to the base 20. A first button 40 has a top surface 42 and a sidewall 44. The first button 40 further defines a volume opening. The first button 40 has a first length and a first width. In the embodiment shown in FIGS. 1-7, the ring re-sizing attachment first button has a top surface 42 with an elongated oval shape.

The first button 40 seats within an opening 50 of a second button 46, where the second button 46 is positioned immediately below the first button 40. The second button 46 further has a sidewall 52. The first button 40 can be pushed into to the opening 50 of the second button 46. The first and second buttons 40, 46 are telescopically aligned.

The first button 40 and second button 46 together seat within an opening 56 of a third button 54. The third button 54 has a sidewall 58 that terminates at a footer 60. The footer 60 is joined to the top surface 26 of the base 22. The first button 40 and second button 46 can be pushed into the opening 56 of the third button 54. The first, second and third buttons 40, 46, 54 are telescopically aligned.

A conical coil spring 30 or "concoil spring" is held within the volume space inside the first, second and third buttons 40, 46, 54. The conical spring 30 forms a helix with windings of varying diameter. The windings share a common center. Generally, a "conical spring" is a cone-shaped compression spring designed to provide a near constant spring rate and a solid height lower than a normal spring. Each conical spring features a variable pitch to achieve the constant spring rate, and coils that nest during deflection to provide a solid height of approximately equal to two wire diameters. When the spring 30 is compressed, the windings nest such that the outermost winding encircles or surrounds the next inner winding and so forth. In a preferred embodiment, the conical spring 30 can be fully compressed with its windings all seated in a common plane. In the embodiment shown in FIGS. 1-7, the conical spring 30 has windings of an elongated oval configuration. Windings of other configuration may be used.

Preferably, the base 22 has an arcuate bottom surface 24 to match the curvature of the inner circumferential surface 18 of the ring band 12. Preferably, the top surfaces of the buttons 42, 48 are arcuate and also match the curvature of the inner circumferential surface 18 of the ring band 12. In the embodiment shown in FIGS. 1-3, if the ring band 12 is considered with reference to a clock face, and the setting 14 is positioned at the 12 o'clock location of the reference clock face, the first ring re-sizing attachment 20 is located at about 4 o'clock or 4:30 o'clock, and the second ring re-sizing attachment 20 is located at about 7 o'clock or 7:30 o'clock. Stated differently, the first ring re-sizing attachment is spaced in the range of about 95 degrees to 175 degrees from the setting 14, which is a predetermined reference point, and the second ring re-sizing attachment is spaced apart from the first ring re-sizing attachment, and appended or joined to the inner circumference at a location approximately 185 to 265 degrees from the predetermined reference point.

The button and base may be formed of polymers, precious metals and metals. Suitable precious metals include gold, gold alloys, silver, silvery alloys, platinum, and platinum alloys. Suitable metals include stainless steel. Suitable polymers include moldable thermosetting plastics and polyurethanes.

Figure 6:
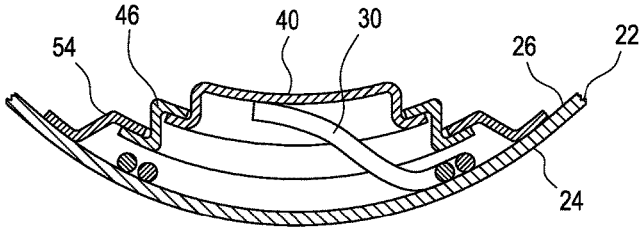
FIG. 6 is a cross-sectional view of the ring re-sizing attachment taken along line 6-6 of FIG. 4.
Figure 7:
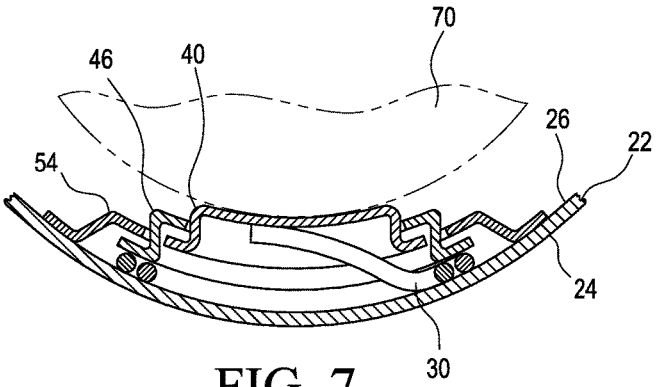
FIG. 7 is a cross-sectional view of the ring re-sizing attachment comparable to FIG. 6, but showing in phantom line a representation of a partial finger compressing against the ring re-sizing attachment.

A ring re-sizing attachment 20 of the first embodiment is shown in an uncompressed configuration in FIG. 6. The conical spring 30 urges the first button 40 and second button 46 away from the base 22. To compare, the ring re-sizing attachment 20 is shown in a compressed configuration in FIG. 7. A finger 70 is pushing the first button 40 into the opening 50 of the second button 46 and the second button 46 into the opening 56 of the third button 54. The height of the ring re-sizing attachment thus is reduced from a first height H1 to a second height H2, where H1>H2. See also FIGS. 2 and 3.

Figure 8:
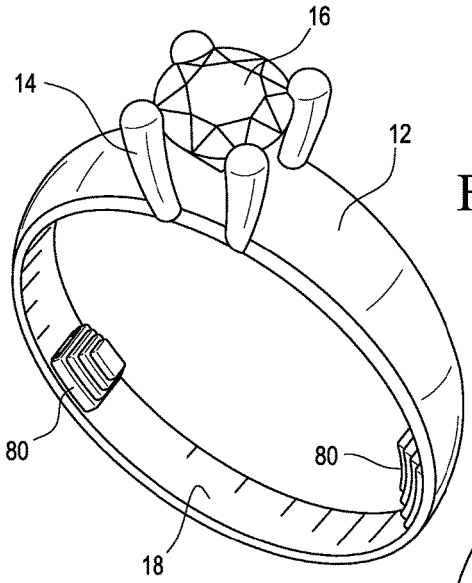
FIG. 8 a right front perspective view of a ring that has two ring re-sizing attachments according to a second embodiment of the invention appended thereto.
Figure 9:
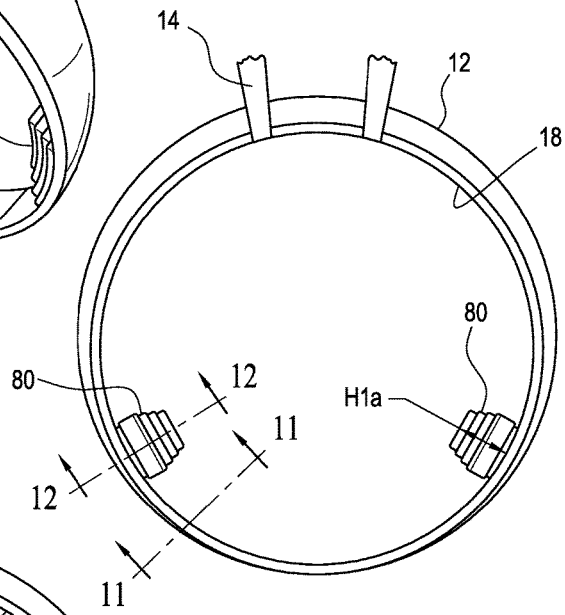
FIG. 9 is a front elevation view of the ring with ring re-sizing attachments of FIG. 8, with the diamond setting not shown.
Figure 10:
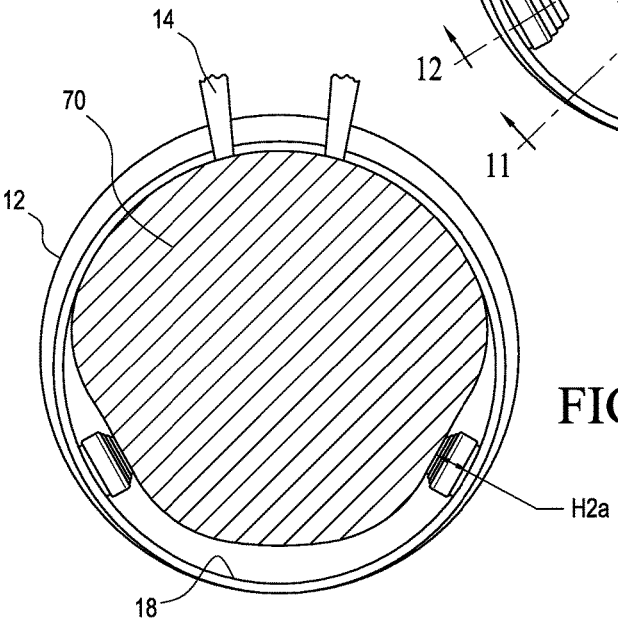
FIG. 10 is a front elevation view of the ring with ring re-sizing attachments of FIG. 8, with the diamond setting not shown, and with a representation of a user's finger in the ring depressing the ring re-sizing attachments.
Figure 11:
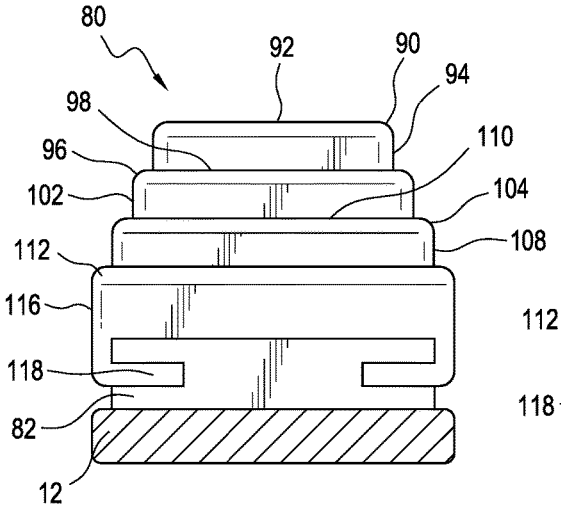
FIG. 11 is a cross-sectional view of the ring of FIG. 8 taken along line 11-11 of FIG. 8, showing a side elevation view of one ring re-sizing attachment.
Figure 12:
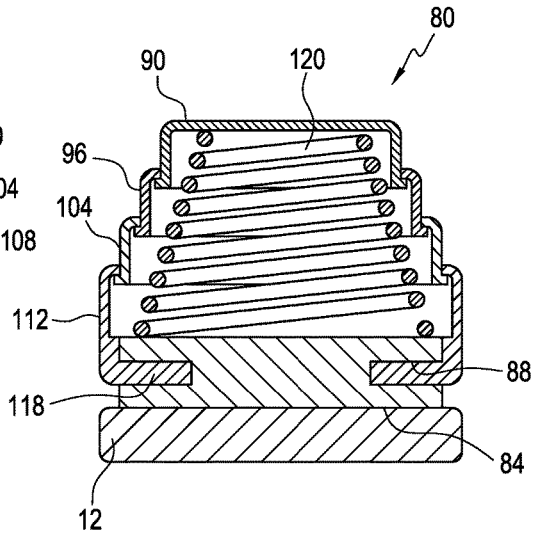
FIG. 12 is a cross-sectional view of the ring of FIG. 8 taken along line 12-12 of FIG. 8 showing a cross-sectional view also of one ring re-sizing attachment.
Figure 13:
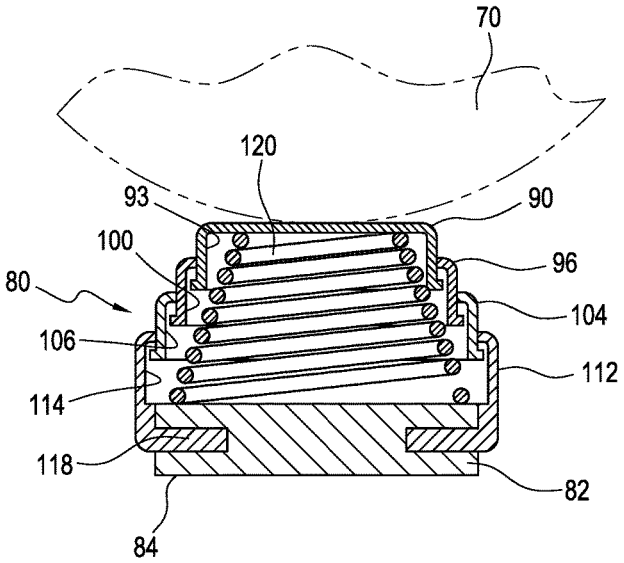
FIG. 13 is a cross-sectional view of the ring re-sizing attachment comparable to FIG. 12, but showing in phantom line a representation of a partial finger compressing against the ring re-sizing attachment.

Referring next to FIGS. 8-13, a ring re-sizing attachment 80 of a second embodiment of the invention is shown. In FIGS. 8-10, two ring re-sizing attachments 80 are attached to an inner surface 18 of a ring band 12 of a ring 10.

Each ring re-sizing attachment 80 has a base 82 that is appended to the inner surface 18 of the ring band 12. The base 82 defines a groove or slots 88.

Each ring re-sizing attachment 80 further has a first button 90 that has a top surface 92 and a sidewall 94 that define an inner volume 93 of the first button. A second button 96 has a sidewall 102 and defines an opening 100 in its top surface 98 of a shape and size adapted to receive the first button 90 therein. A third button 104 has a sidewall 108 and defines an opening 106 in its top surface 110 of a shape and size adapted to receive the second button 96 and the first button 90 therein in telescoping fashion. A fourth button 112 has a sidewall 116 and defines an opening 114 in its top surface of a shape and size adapted to receive the third button 104, the second button 96 and the first button 90 in telescoping fashion. The top surface 92 of the first button is shown with a square shape with rounded corners, but the invention is not limited to such shape, and other shapes that permit telescoping nested relation are contemplated.

The sidewall 116 of the fourth button 112 terminates in a bent angle or foot 118 that seats within the groove or slots 88 formed in the base 82 to secure the fourth button 112 to the base 82.

A conical spring 120 is held within the volume space of the buttons 90, 96, 104 and 112 between the base 82 and first button 90. The conical spring 120 is shown as a helix with windings of circular shape, with decreasing radii along the center axis of the spring. The windings compress and collapse together in concentric relation as the first button 90 is pushed toward the base 82.

In the embodiment shown in FIGS. 8-13, the top surface 92 of the first button 90 has a generally flat surface, as compared to the arcuate or curved surface shown for the first button 40 of the first embodiment. And, the base 82 has a generally flat bottom surface 84 as compared to the arcuate or curved bottom surface 24 of the first embodiment.

Comparing FIG. 9 and FIG. 10, the ring re-sizing attachments 80 are shown in an uncompressed state having a height of H1*a* in FIG. 9. In FIG. 10, the ring re-sizing attachments 80 are showing in compressed state due to finger 70 in the ring band 12. In compressed state, the ring re-sizing attachments 80 have a height H2*a*, where H1*a*>H2*a*.

The ring re-sizing attachments 20, 80 have advantages over the prior art methods for adjusting ring size. The ring band 12 need not be drilled or modified to receive the ring re-sizing attachments 20, 80. Nor is the ring band 12 marred or weakened by welding or other machining. Nor is any structure contacting the outer circumference of the ring band 12, so the ornamental appearance of the exterior of the ring 10 is not altered. In the preferred embodiments, the ring re-sizing attachments are joined to the inner circumference of the ring band with adhesive. One exemplary suitable adhesive is E6000 medium viscosity industrial perchloroethylene adhesive.

As such, it will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A ring re-sizing attachment, comprising:

a base having a bottom surface adapted for appending to an inner circumferential surface of a ring band and having a top surface opposite the bottom surface;

at least a first button having a top surface and a first length and first width, and defining an inner volume;

at least a second button having a top surface and a second length and second width different from the first length and first width, and defining an opening to receive the first button in telescoping relation; and a spring in contact with the top surface of the base and held at least in part in the inner volume, said spring adapted to urge the at least first button and at least second button away from the top surface of the base.

2. The ring re-sizing attachment of claim 1, further comprising a third button having a top surface and a third length and third width different from the first length and first width, and defining an opening to receive the second button and the first button in telescoping relation.

3. The ring re-sizing attachment of claim 2, wherein the third button has a sidewall and terminates in a footer, and said footer is either joined to or integral with the top surface of the base.

4. The ring re-sizing attachment of claim 1, further comprising adhesive to append the bottom surface of the base to the inner circumferential surface of the ring band.

5. The ring re-sizing attachment of claim 1, wherein the top surface of the at least first button is arcuate.

6. The ring re-sizing attachment of claim 1, wherein the spring is a conical coil spring.

7. A jewelry ring, comprising:

a band adapted to fully or substantially fully encircle a user's finger when the jewelry ring is worn, said band defining an inner circumference; and a first ring re-sizing attachment appended or joined to the inner circumference of the band, said ring re-sizing attachment comprising: (i) a base having a bottom surface adapted for appending to an inner circumferential surface of the band, and having a top surface opposite from the bottom surface; (ii) at least a first button having a top surface and a first length and first width, and defining an inner volume; (iii) at least a second button having a top surface and a second length and second width different from the first length and first width, and defining an opening to receive the first button in telescoping relation; and (iv) a spring in contact with the top surface of the base and held at least in part in the inner volume, said spring adapted to urge the at least first button and at least second button away from the top surface of the base.

8. The jewelry ring of claim 7, further comprising: a second ring re-sizing attachment appended or joined to the inner circumference of the band at a location spaced apart from the first ring re-sizing attachment.

9. The jewelry ring of claim 8, wherein the band is circular, and the first ring re-sizing attachment is appended or joined to the inner circumference at a location approximately 95 degrees to 175 degrees from a predetermined reference point and the second ring re-sizing attachment is appended or joined to the inner circumference at a location approximately 185 to 265 degrees from the predetermined reference point.

10. The jewelry ring of claim 7, wherein the first ring re-sizing attachment is joined to the inner circumference with adhesive.

11. The jewelry ring of claim 7, wherein the spring is a conical coil spring.

* * * * *